US008757106B2

(12) United States Patent
Gunter et al.

(10) Patent No.: US 8,757,106 B2
(45) Date of Patent: Jun. 24, 2014

(54) HIGH CETANE PETROLEUM FUELS

(75) Inventors: Garry Clyde Gunter, Bartlesville, OK (US); Edward T. Casey, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 299 days.

(21) Appl. No.: 13/304,801

(22) Filed: Nov. 28, 2011

(65) Prior Publication Data

US 2012/0132182 A1 May 31, 2012

Related U.S. Application Data

(60) Provisional application No. 61/418,177, filed on Nov. 30, 2010.

(51) Int. Cl.
*F02B 43/04* (2006.01)
*F02B 43/02* (2006.01)

(52) U.S. Cl.
USPC ..... 123/1 A; 123/568.11

(58) Field of Classification Search
USPC ..... 123/1 A, 27 R, 27 GE, 568.11; 44/301, 44/302, 309; 585/14, 331, 709
See application file for complete search history.

(56) References Cited

U.S. PATENT DOCUMENTS

| | | | | |
|---|---|---|---|---|
| 3,776,247 | A * | 12/1973 | Choufoer et al. | 137/13 |
| 6,387,138 | B1 * | 5/2002 | Murayama et al. | 44/387 |
| 6,458,265 | B1 * | 10/2002 | Miller et al. | 208/137 |
| 6,736,866 | B2 * | 5/2004 | Tsai | 44/301 |
| 7,208,078 | B2 * | 4/2007 | Weissman et al. | 208/15 |
| 7,217,852 | B1 * | 5/2007 | DeHaan et al. | 585/734 |
| 2001/0003881 | A1 * | 6/2001 | Ahmed | 44/302 |
| 2002/0092228 | A1 * | 7/2002 | Ahmed | 44/302 |
| 2004/0194367 | A1 | 10/2004 | Clark et al. | |
| 2009/0158641 | A1 * | 6/2009 | Hayes et al. | 44/309 |
| 2009/0209793 | A1 * | 8/2009 | Selby et al. | 585/1 |
| 2010/0146947 | A1 * | 6/2010 | Liu et al. | 60/295 |

FOREIGN PATENT DOCUMENTS

| | | |
|---|---|---|
| EP | 0728835 | 8/1996 |
| WO | 0020535 | 4/2000 |
| WO | 0149812 | 12/2001 |

OTHER PUBLICATIONS

U.S. Appl. No. 61/375,334.
Bielaczyc, et al., "Effects of Fuel Properties on Exhaust Emissions from the Latest Light-Duty Di Diesel Engine." SAE Paper 2003-01-1882 (2003).
Briker, et al., "Diesel Fuel Analysis by GC-FIMS: Normal Paraffins, Isoparaffins, and Cycloparaffins," Energy & Fuels 15:996-1002 (2001).
Cho, et al., Experimental investigation of the effects of fuel characteristics on high efficiency clean combustion (HECC) in a light-duty diesel engine. SAE Paper 2009-01-2669 (2009).
Fujimoto, et al., "Exhaust Emission Through Diesel Combustion of Mixed Fuel Oil Composed of Fuel With High Volatility and That with Low Volatility." SAE Paper 2004-01-1845 (2004).
Ghosh, "Predicting the Effect of Cetane Improvers on Diesel Fuels," Energy & Fuels, 22:1073-1079 (2008).
Kawamoto, et al., "Combination of Combution Concept and Fuel Property for Ultra-Clean DI Diesel." SAE Paper 2004-01-1868 (2004).
Kitano, et al., "Effects of Fuel Properties on Premixed Charge Compression Ignition Combustion in a Direct Injection Diesel Engine." SAE Paper 2003-01-1815 (2003).
Nishiumi, et al., "Effects of Cetane Number and Distillation of Paraffinic Diesel Fuels on PM Emission from a DI Diesel Engine." SAE Paper 2004-01-2960 (2004).
Ogawa and Okada, "Influence of Properties and Composition of Diesel Fuels on Particulate Emissions: Part 2. Fuels for Single-Cylinder Engine Test in the Combustion Analysis for the WG of JCAP" R&D Review of Toyota CRDL 38:54-67 (2003).
Yang, et al., "Neural Network Prediction of Cetane Numbers for Isoparaffins and Diesel Fuel." Petr. Sci. Technol. 19:573 (2001).
Zannis, et al., "Experimental Study of Diesel Fuel Effects on Direct Injection (DI) Diesel Engine Performance and Pollutant Emissions." Energy & Fuels 21:2642-54 (2007).
PCT/US2011/062239 PCT International Search Report (PCT/ISA/210) Dated Feb. 6, 2012.

* cited by examiner

*Primary Examiner* — Mahmoud Gimie
(74) *Attorney, Agent, or Firm* — Phillips 66 Company

(57) ABSTRACT

A high-efficiency diesel fuel and method of combustion that reduces emissions. The diesel engine can operate in premixed charge compression ignition (PCCI) combustion. The method can involve injecting high-efficiency diesel fuel at from −8 to 0 degrees After Top Dead Center (ATDC), combusting the fuel, and operating the engine with an exhaust gas recirculation (EGR) of from 20 to 60%.

24 Claims, No Drawings

HIGH CETANE PETROLEUM FUELS

CROSS-REFERENCE TO RELATED APPLICATIONS

This application is a non-provisional application which claims benefit under 35 USC §119(e) to U.S. Provisional Application Ser. No. 61/418,177 filed Nov. 30, 2011, entitled "HIGH CETANE PETROLEUM FUELS," which is incorporated herein in its entirety.

FIELD OF THE INVENTION

The following relates to diesel combustion, and more particularly to reducing emissions associated with diesel combustion.

BACKGROUND OF THE INVENTION

Diesel fuels are available from a variety of sources with a variety of desirable and undesirable properties. Diesel fuel provides better lubricity than other petroleum fuels and the diesel engine offers more efficient combustion than a standard gasoline engine. Unfortunately diesel engines are frequently associated with increased pollution, including $NO_X$, particulate, and other emissions. Direct-injection diesel engines can significantly increase fuel economy without sacrificing attributes and will likely meet or exceed increasing emission standards with additional improvements.

Diesel engines are a well established technology in Europe that captured over half of the passenger car market in model years 2007-2008 (Schmidt's, 2010). Developing a highly efficient diesel system with an efficient engine and quality fuel will lead to greater adoption of diesel fuels in the future. As diesel engines improve, they continue to reduce emissions, improve fuel economy, and decrease environmental impact.

Because diesel fuels are readily available from a variety of sources, petroleum based diesel (petrodiesel), renewable biological diesels (biodiesels), synthetic diesel, and others, diesel engines must be able to operate efficiently with a variety of different fuel sources. Diesels may be incorporated and blended to meet market needs, government standards, and higher environmental initiatives. Currently, the vast majority of diesel fuel is derived from petroleum sources although biofuels and synthetic diesels are being developed. Unfortunately, to date renewable biofuels and synthetic diesels are far too expensive to meet current diesel fuel requirements.

In order to meet ever increasing diesel emission standards, reduce fuel consumption, and meet current diesel fuel requirements, an inexpensive source of diesel fuel with low emissions is required.

BRIEF SUMMARY OF THE DISCLOSURE

The invention more particularly includes high-efficiency diesel (HE-diesel) fuel blends with high cetane values including fuel blends with greater than 80% isoparaffins.

In one embodiment, HE-diesel fuel contains a mix of short-chain paraffin molecules, and long chain paraffins with one to five isomeric short chain methyl, ethyl, propyl, or isopropyl sidechains. The HE-diesel fuel may be a blending agent with increased short-chain paraffin molecules, and long chain paraffins with one to five isomeric short chain methyl, ethyl, propyl, or isopropyl sidechains.

In another embodiment, diesel engine emissions are reduced with a combusting fuel having a HE-diesel fuel with increased short-chain paraffin molecules and long chain paraffins with one to five isomeric short chain methyl, ethyl, propyl, or isopropyl sidechains, wherein the HE-diesel fuel is injected at from −8 to 0 degrees After Top Dead Center (ATDC), and operating the engine with an exhaust gas recirculation (EGR) from 20 to 60%.

In one example, the HE-diesel fuel may contain short chain paraffins selected from C10, C11, C12, C13, C14, or C15 paraffins. In another example, the HE-diesel fuel may contain long chain paraffins with C15, C16, C17, C18, C19, C20, C21, C22, C23, C24, C25 or C26 isoparaffins, and the sidechains have 1-5 carbons in each of the sidechains, with less than 50 percent of the total carbons in sidechains. The ratio of isoparaffins to total paraffins may be more than 0.8, 0.9, or 0.99 isoparaffins to total paraffins. The HE-diesel fuel may contain short chain paraffins (C10-C15) and long chain isoparaffins (C15-C26) from diesel, kerosene, fuel oils, isomerized lube oil stocks, or other high paraffin fuel sources. The cetane number is greater than conventional diesel fuel and may range from about 51 to about 81, including derived cetane numbers of greater than 60, 65, 70, 75, 80, or more. Cetane number may vary for the HE-diesels from 45 to 51, 51 to 81, above 81, or even greater than 85. The composition of the HE-diesel may even exceed 100 cetane which may be used as an HE-diesel or as a blending agent to raise the cetane value of another feedstock.

With the HE-diesel described, combustion efficiency may improve about 98% and 99%, NOX emissions are reduced to between about 0.5 g/kgfuel to 2.5 g/kgfuel, matter emissions are reduced to between about 0.4 g/kgfuel to 0.75 g/kgfuel, total hydrocarbon emissions are reduced to between about 2 g/kgfuel to 4 g/kgfuel, carbon monoxide emissions are reduced to between about 8.5 g/kgfuel to 15 g/kgfuel, brake thermal efficiency increased by about 1.0% to 2.0%, compared to an similar testing methods with a conventional diesel fuel. The HE-diesel fuel results in a decrease in nitrogen oxide (NOX) emissions of greater than 10%, including at least about 17%, 18%, 19%, 20% or greater, compared to identical testing methods wherein the fuel is a conventional diesel fuel.

With the HE-diesel described, particulate matter emissions may be reduced by more than 55%, including reductions of about 63%, 65%, 68%, 70%, or greater, compared to identical testing methods wherein the fuel is a conventional diesel fuel. Additionally, the HE-diesel fuel may result in a decrease of total hydrocarbon emissions by greater than 75%, including at least about 80%, 85% 90% or greater, compared to an identical method wherein the fuel is a diesel fuel. The HE-diesel fuel may decrease in carbon monoxide emissions by more than 70%, 75%, 80%, or greater, compared to an identical method wherein the fuel is a diesel fuel. The HE-diesel fuel may be a blended diesel fuel stock comprising one or more components including a HE-diesel fuel, a cetane enhancer, an LTFT fuel, high-cetane distillates, high-cetane straight-run distillate, high-cetane overhead products, paraffin, isoparrafins, ethyl hexyl nitrate (EHN), and combinations.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Abbreviations are used in this application, including the following: after top dead center (ATDC), brake specific fuel consumption (BSFC), brake thermal efficiency (BTE), carbon monoxide (CO), derived cetane number (DCN), electronic control unit (ECU), end of injection (EOI) timings, exhaust gas recirculation (EGR), high efficiency clean combustion (HECC), high temperature Fischer-Tropsch (HTFT) fuel, homogenous charge compression ignition (HCCI) combustion, hydrocarbon (HC), ignition delay (ID), insoluble fraction (ISF), low temperature combustion (LTC), low temperature Fischer-Tropsch (LTFT) fuel, modulated kinetics (MK), nitrogen oxides ($NO_X$), Paraffin Enhanced Clean Combustion (PECC), particulate matter (PM), pre-mixed charge compression ignition (PCCI) combustion, rate of heat release (ROHR), smokeless locally rich diesel combustion (SRDC), soluble organic fraction (SOF), spark ignited (SI), start of combustion (SOC), start of injection (SOI), top-dead-center (TDC), and total hydrocarbons (THC).

Researchers have developed highly efficient diesel engines, including light-duty turbodiesel engines that may be operated in an advanced diesel combustion mode, specifically high efficiency clean combustion (HECC). See "Advanced Diesel Combustion with Low Hydrocarbon and Carbon Monoxide Emissions," U.S. App. No. 61/375,334 filed on Aug. 20, 2010 is hereby incorporated by reference in its entirety. Combustion of three different fuels including a conventional diesel fuel, an HTFT fuel, and an LTFT fuel identified high ignition quality (DCN 81) fuels as ideally suited for operation under a high EGR advanced diesel mode and led to reductions in all primary pollutant emissions. Paraffin Enhanced Clean Combustion (PECC) is one synergetic combination of advanced diesel combustion techniques and a highly paraffinic synthetic diesel fuel that led to a simultaneously reduction of $NO_X$, PM, THC, CO emissions while maintaining thermodynamic efficiency.

Modifications of fuel composition and fuel properties have the potential to optimize PCCI operation processes, such as HECC, and eliminate undesirable effects arising from increasing the fraction of pre-mixed combustion. Fuel properties are directly dictated by the molecular structure of the hydrocarbons in the fuel. Normal alkanes, branched alkanes, cyloalkanes, alkenes and aromatics account for the major species that comprise conventional liquid hydrocarbon fuels.

Cetane number (CN) is a measure of the ease with which a diesel fuel ignites by compression. It is a specification of the fuel ignition quality and is quantified by the delay between the time of injection into an engine and the start of combustion. The shorter the ignition delay period, the higher the CN. CN is often seen as a fuel property that reflects various fuel performance characteristics, such as cold startability, cold smoke, noise, power, fuel consumption, and exhaust emission. Chemically it is more accurate to consider CN not as a property, but as "a variable dependent on the chemical composition of the fuel" (Indritz, 1985). The primary reference fuels for the CN test are 2,2,4,4,4,6,8,9-heptamethylnonane (also known as HMN or isocetane, CN=15) and hexadecane (also called cetane, CN=100). Other cetane standards have been used in the past and many must be converted to today's CN standard, dependent upon the reference fuel used and method of measuring CN. CN may also be measured by using secondary reference fuels rather than the primary reference fuels just mentioned above. Two current secondary reference fuels are designated U-11 (CN=20.5) and T-18 (CN=75), combinations of which are used as bracketing reference fuels for unknowns with CN in the range 20.6-75. For unknowns with 15<CN<20.5, HMN and U-11 are used. For unknowns with 75<CN<100, T-18 and cetane are used. A typical conventional diesel fuel ranges in cetane number between 40 and 55.

Octane number (ON) is an engine test that determines the knocking tendency of gasoline-type fuels. ON is the resistance of the fuel to compression ignition in the end gas (i.e., the part of fuel/air mixture in the cylinder that has not yet been ignited by the flame front). While CN is a measure of ease of compression ignition, ON is a measure of resistance to it. Therefore, the two ignition properties correlate with each other inversely. Generally speaking, the octane number of hydrocarbons increases as the energy of their C—H and C—C bonds increases in the series, n-alkanes<isoalkanes<alkenes<cycloalkanes<aromatic hydrocarbons. The CN decreases in the same series of hydrocarbons. Also, the CN increases as the molecular weight of a hydrocarbon is increased. Although there is a generally inverse correlation between CN and ON, because of the multiple properties that go into CN and ON, the relationship may not be directly proportional under all conditions. Desirable fuel combustion properties may lead to variances in CN, ON, cold startability, cold smoke, noise, power, fuel consumption, exhaust emissions, and other properties that improve fuel quality without a corresponding changes in all of the fuel properties.

Materials and methods provided below are examples of measurements and data that may be collected to analyze diesel fuel quality and efficiency. The methods provided below are non-limiting examples of analysis techniques that are used for diesel fuel testing. One or more of these methods may be used to determine the quality and efficiency of the fuels developed herein.

In one embodiment, a common rail turbodiesel engine may be operated in the HECC advanced diesel combustion mode. The engine is operated at steady state conditions with a constant speed and load. The start of injection (SOI) timing command may be swept from −8° ATDC to 0° ATDC to find an optimized injection condition for each fuel tested. Low $NO_X$, PM, THC and CO emissions may be achieved, while preserving thermal efficiency by combining an advanced combustion process with a high ignition quality fuel. In another embodiment a DDC/VM Motori 2.5 L, 4-cylinder, turbocharged, common rail, direct injection, Euro 3 compliant light-duty diesel engine with an unlocked electronic control unit (ECU) may be coupled to a 250 HP Eaton eddy current water-cooled dynamometer. The engine and dynamometer is controlled by a DIGALOG TESTMATE™ control unit.

Particulate matter (PM) may be sampled through a Sierra Instruments BG-3 micro-dilution tunnel using a dilution ratio of 10:1 with a sampling duration of 5 minutes for each of the three filters acquired per test mode. The BG-3 micro-dilution tunnel sampling parameters may be optimized to collect particulate samples over the widest range of test points. Soxhlet extraction is performed on the PM filters using dichloromethane as a solvent for 24 hours with approximately 300 wash cycles.

An AVL Combustion Emissions Bench II (CEB-II) (AVL, Graz, Austria) is used to measure gaseous emissions. $NO_X$ and NO are measured using an EcoPhysics chemiluminescence analyzer. Without additional analysis, $NO_2$ is assumed to be the difference between $NO_X$ and NO. Total hydrocarbons and methane can measured by using ABB flame ionization detectors. Total hydrocarbons are reported on the basis of $C_3$, by using a propane-$N_2$ mixture as the calibration gas. CO and $CO_2$ may be measured by two separate Rosemount infrared analyzers, and $O_2$ can be measured by using a Rosemount paramagnetic analyzer. Hot exhaust samples going to CO, $CO_2$, and $O_2$ analyzers may be chilled or dried to reduce moisture. Emissions were reported on the basis of dry moles. Temperature, pressure, and emissions data can be sampled at a variety of intervals, in one example samples are measured every 10 seconds under steady state operating conditions.

Pressure traces can be measured using AVL GU12P pressure transducers, in place of glow plugs in one or more of the four cylinders. The voltages from the pressure transducers may be amplified for example by Kistler type 5010 dual mode amplifiers (Kistler Holding AG, Winterthur, Switzerland). Voltages, either direct or amplified, can be recorded by an AVL IndiModul 621 data acquisition system. Needle lift data were collected from a Wolff Controls Inc. Hall-effect needle lift sensor, which was placed on the injector of cylinder 1. The needle lift signal was also collected by the IndiModul, which was triggered by a crank angle signal from an AVL 365C angle encoder placed on the crankshaft. The pressure traces and needle lift data were recorded at a resolution of 0.1 crank angle degrees, and were averaged over 200 cycles. The real-time IndiModul data was transferred to a PC, which ran AVL IndiCom 1.3 and Concerto 3.90 software to calculate the apparent heat release rate (AVL Concerto SoftVersion 3.9 Software Guide, 2006).

The following examples of certain embodiments of the invention are given. Each example is provided by way of explanation of the invention, one of many embodiments of the invention, and the following examples should not be read to limit, or define, the scope of the invention.

Example 1

A common rail turbodiesel engine is operated in the HECC advanced diesel combustion mode. Fuels are tested against standard diesel fuels to determine CN and emission properties of each fuel type. The engine is operated at steady state conditions with a constant speed and load. The start of injection (SOI) timing command is swept from −8° ATDC to 0° ATDC to find an optimized injection condition for each specific fuel. Low $NO_X$, PM, THC and CO emissions are achieved, while preserving thermal efficiency by combining an advanced combustion process with a high ignition quality fuel. Table 1 identifies fuel properties for fuels tested and proposed for use as HE-diesel fuels compared against conventional diesel.

A highly isomerized diesel fuel was developed using a lubrication hydrocracker overhead stream (HE-Diesel 1). This stream is high in isomerized paraffins with over 90% of the paraffins isomerized. The isomerized paraffins range in size from C9-C26 paraffins, most of the paraffins having between 12 and 24 carbons per molecule. Isomerized paraffins have between 1 and 5 sidechains with many having about 3 or 4 sidechains per molecule. The sidechains range in length from 1 to 5 carbons per sidechain. Many of the isomerized paraffins have 6-10 carbons in sidechains some having up to 12 or 13 hydrocarbons in sidechains.

TABLE 1

Properties of fuels examined

| | Diesel | HE-Diesel 1 | HE-Diesel 2 |
|---|---|---|---|
| Density (g/cm$^3$)[a] | 0.84 | | |
| Kinematic viscosity (cSt)[b] | 2.5 | | |
| Heat of Combustion (MJ/kg)[c] | 45.7 | | |

TABLE 1-continued

Properties of fuels examined

| | | Diesel | HE-Diesel 1 | HE-Diesel 2 |
|---|---|---|---|---|
| ppm S (wt)[d] | | 9.7 | | |
| Carbon (mass %)[e] | | 85.2 | | |
| Hydrogen (mass %)[e] | | 12.8 | | |
| Nitrogen (mass %)[e] | | 0.01 | | |
| Distillation[f] | IBP (° C.) | 133 | | |
| | T50 (° C.) | 256 | | |
| | T90 (° C.) | 329 | | |
| Derived Cetane Number[g] | | 45 | | |
| Aromatics (vol %)[h] | | 31.5 | | |
| Olefins (vol %)[h] | | 1.7 | | |
| Saturates (vol %)[h] | | 66.8 | | |
| Paraffins | | 15-25% | >25% | 50% |
| Isoparaffins | | 6-15% | >17% | 45% |
| Cycloparaffins | | 6-20% | <10% | 5% |
| Isoparaffins/Total Paraffins | | 0.25-0.7 | 0.75-0.99 | .9 |

Test Methods:

[a]ASTM D-4052;

[b]D-445;

[c]ASTM D-240;

[d]ASTM D-5453;

[e]D-5291-02;

[f]ASTM D-2887;

[g]ASTM D-6890;

[h]ASTM D-1319.

Example 2

Properties for HE-diesel fuels can be modified by adjusting the concentration of paraffins, ratio of isoparaffins to total paraffins, increasing cetane improver concentration, and blending higher cetane compositions. Table 2, below outlines properties for conventional diesel, HTFT, LTFT, (1) petroleum based isoparaffins, (2) high cetane overheads blended with napthenes, (3) conventional diesel with extremely high concentrations of cetane improvers, (4) short chain paraffins, (5) isomerized long chain isoparaffins (C15-C26), (6) petroleum based isoparaffins from C10-C15, (7) increased isomerization up to 50% of the C sidechains, (8) blend of (6) and (7). Qualitative analysis of various HE-diesel properties including approximate cetane value (Normal less than 51, moderate from 51-81, and high greater than 81). Fuels will contain significant amounts of paraffins (P), isoparaffins (I), napthenes (N), aromatics (A), and cetane index (CI) as described in composition. Additionally, fuels will contain a greater distribution of long and short chain hydrocarbons. In this example, long chain hydrocarbons contain from 15 to 26 carbons with varying numbers and lengths of sidechains and relatively shorter hydrocarbons contain from 10 to 15 hydrocarbon. Isomerization can be anywhere from 1 to 5 sidechains varying in length from methyl and ethyl sidechains to butyl, propyl, and isopropyl sidechains.

TABLE 2

Composition properties of HE-Diesel fuels

| | Standard Fuel | | | Cetane | | | Composition | | | | | Dist. | |
|---|---|---|---|---|---|---|---|---|---|---|---|---|---|
| | Diesel | HTFT | LTFT | <51 | 51-81 | >81 | P | I | N | A | CI | L | S |
| Diesel | X | | | X | | | X | X | X | X | | X | X |
| HTFT | | X | | X | | | X | X | | X | | X | X |
| LTFT | | | X | | | X | X | | | | | X | |
| 1 | | | X | | | X | X | | | | | X | |
| 2 | | | X | | | X | X | X | X | | | X | |
| 3 | | | X | | | X | X | X | X | X | X | X | X |
| 4 | X | | | | X | | X | | | | | | X |
| 5 | X | | | | X | | X | X | | | | X | |
| 6 | | | X | | X | | X | | | | | | X |
| 7 | | | X | | X | | X | X | | | | X | |
| 8 | | | X | | X | | X | X | | | | | |

In one embodiment, a HE-diesel fuel is processed from a petroleum feedstock by isomerizing paraffins from fuel oil, diesel, kerosene or other petroleum feedstock. The feedstock may be a conventional or blended feedstock dependent upon the requirements for isomerization. Paraffins are isomerized using an isomerization catalyst selected from UOP I-82 catalyst, I-84 catalyst, I-122 catalyst, or I-124 catalyst, Abermarle ATIS-2L or ATIS-1L, as well as other catalysts that will have varying activity dependent upon paraffin content and the composition of the petroleum feedstock.

In one embodiment, a blended HE-diesel fuel may be developed improving cetane number by increasing isoparaffin/paraffin ratio, alcohol and esther content, and using high cetane distillates, that can be modified to meet increased governmental emission standards in a variety of diesel engines. In a HECC or PCCI engine, emissions are reduced from 70-90% by modifying petroleum isoparaffin content.

The ability to develop HE-diesel fuels is essential to continue improving emission qualities for diesel fuels. Although many green development options have been proposed, gasoline engines, hybrids, and electric vehicles still produce large quantities of carbon dioxide, either at the tailpipe or at the electric plant. Diesel fuels could dramatically reduce pollution because of the increase combustion efficiency, lower emissions, and ability to use a wider range of fuel sources.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed here for convenience:

1. U.S. App. No. 61/375,334, "Advanced Diesel Combustion With Low Hydrocarbon And Carbon Monoxide Emissions," filed on Aug. 20, 2010.
2. Akihama, et al., "Mechanism of the Smokeless Rich Diesel Combustion by Reducing Temperature." SAE Paper 2001-01-0655 (2001).
3. Asanuma, et al., "Effect of Sulfur-Free and Aromatics-Free Diesel Fuel on Vehicle Exhaust Emissions using Simultaneous PM and NOx Reduction Systems." SAE Paper 2003-01-1865 (2003).
4. AVL, AVL Concerto SoftVersion 3.9 Software Guide. In 2006; Vol. AT1635E Rev. 03.
5. Bielaczyc, et al., "Effects of Fuel Properties on Exhaust Emissions from the Latest Light-Duty Di Diesel Engine." SAE Paper 2003-01-1882 (2003).
6. Briker, et al., "Diesel Fuel Analysis by GC-FIMS: Normal Paraffins, Isoparaffins, and Cycloparaffins," Energy & Fuels 15:996-1002 (2001).
7. Chen and Sperling, "Case Study of Light-Duty Diesel Vehicles in Europe." California Air Resources Board, Final Report, Contract 02-310, Project No. 008545 (2004).
8. Cho, et al., Experimental investigation of the effects of fuel characteristics on high efficiency clean combustion (HECC) in a light-duty diesel engine. SAE Paper 2009-01-2669 (2009).
9. Dec, "A Conceptual Model of DI Diesel Combustion Based on Laser-Sheet Imaging." SAE Paper 970873 (1997).
10. Fujimoto, et al., "Exhaust Emission Through Diesel Combustion of Mixed Fuel Oil Composed of Fuel With High Volatility and That with Low Volatility." SAE Paper 2004-01-1845 (2004).
11. Ghosh, "Predicting the Effect of Cetane Improvers on Diesel Fuels," Energy & Fuels, 22:1073-1079 (2008).
12. Hardenberg and Ehnert, "Ignition quality determination problems with alternative fuels for compression ignition engines," SAE Paper 811212 (1981).
13. Indritz, "What Is Cetane Number?" Prep. Am. Chem. Soc. Div. Pet. Chem., 30:282 (1985).
14. Kawamoto, et al., "Combination of Combution Concept and Fuel Property for Ultra-Clean DI Diesel." SAE Paper 2004-01-1868 (2004).
15. Kitano, et al., "Effects of Fuel Properties on Premixed Charge Compression Ignition Combustion in a Direct Injection Diesel Engine." SAE Paper 2003-01-1815 (2003).

16. Nishiumi, et al., "Effects of Cetane Number and Distillation of Paraffinic Diesel Fuels on PM Emission from a DI Diesel Engine." SAE Paper 2004-01-2960 (2004).
17. Ogawa and Okada, "Influence of Properties and Composition of Diesel Fuels on Particulate Emissions: Part 2. Fuels for Single-Cylinder Engine Test in the Combustion Analysis for the WG of JCAP" R&D Review of Toyota CRDL 38:54-67 (2003).
18. Schmidt's Diesel Car Prospects to 2013 (2010).
19. Suppes, et al., "Impact of cetane improvers on ignition delay times of several alternative biofuels. Bioenergy '96 The Seventh National Bioenergy Conference. Southeastern Regional Biomass Energy Program, 1996b; p 377.
20. Suppes, et al., "Cetane-Improver Analysis and Impact of Activation Energy on the Relative Performance of 2-Ethylhexyl Nitrate and Tetraethylene Glycol Dinitrate." Ind. Eng. Chem. Res. 36:4397-404 (1997).
21. Yang, et al., "Neural Network Prediction of Cetane Numbers for Isoparaffins and Diesel Fuel." Petr. Sci. Technol. 19:573 (2001).
22. Zannis, et al., "Experimental Study of Diesel Fuel Effects on Direct Injection (DI) Diesel Engine Performance and Pollutant Emissions." Energy & Fuels 21:2642-54 (2007).

The invention claimed is:

1. A high-efficiency diesel fuel comprising:
a) increased short-chain paraffin molecules,
b) long chain paraffins with one to five isomeric short chain methyl, ethyl, propyl, or isopropyl side chains,
wherein the ratio of isoparaffins to total paraffins is greater than 0.9.

2. The high-efficiency diesel fuel of claim 1, wherein the high-efficiency diesel fuel comprises short chain paraffins selected from the group consisting of C10, C11, C12, C13, C14, or C15 paraffins.

3. The high-efficiency diesel fuel of claim 1, wherein the high-efficiency diesel fuel comprises long chain paraffins selected from the group consisting of C15, C16, C17, C18, C19, C20, C21, C22, C23, C24, C25 or C26 isoparaffins, wherein the sidechains have 1-5 carbons in each of the sidechains, and less than 50 percent of the total carbons are in sidechains.

4. The high-efficiency diesel fuel of claim 1, wherein the high-efficiency diesel fuel comprises short chain paraffins ($C_{10}$-$C_{15}$) from diesel, kerosene, fuel oils, isomerized lube oil stocks, and other high paraffin fuel sources and long chain isoparaffins ($C_{15}$-$C_{26}$) from diesel, kerosene, fuel oils, isomerized lube oil stocks, and other high paraffin fuel sources.

5. The high-efficiency diesel fuel of claim 1, wherein the high-efficiency diesel fuel has a cetane number great than that of conventional diesel fuel, including a cetane number of about 51 to about 81, including a high efficiency diesel fuel with a derived cetane number of about 60, about 65, about 70, about 75, about 80, about 45 to 51, about 51 to 81, or above about 81, or greater than 85.

6. The high-efficiency diesel fuel of claim 1, wherein the fuel has a combustion efficiency between about 98% and 99%, reduced $NO_X$ emissions from about 0.5 g/kg$_{fuel}$ to 2.5 g/kg$_{fuel}$, reduced matter emissions of from about 0.4 g/kg$_{fuel}$ to 0.75 g/kg$_{fuel}$, reduced total hydrocarbon emissions of from about 2 g/kg$_{fuel}$ to 4 g/kg$_{fuel}$, reduced carbon monoxide emissions of from about 8.5 g/kg$_{fuel}$ to 15 g/kg$_{fuel}$, increases brake thermal efficiency between about 1.0% to 2.0%, compared to an identical method wherein the fuel is a conventional diesel fuel.

7. The high-efficiency diesel fuel of claim 1, wherein the fuel results in a decrease in one or more pollutants including:
a) nitrogen oxide ($NO_X$) emissions of greater than 10%, including at least about 17%, 18%, 19%, 20% or greater, compared to an identical method wherein the fuel is a diesel fuel;
b) particulate matter emissions of greater than 55%, including about 63%, 65%, 68%, 70%, or greater, compared to an identical method wherein the fuel is a diesel fuel;
c) total hydrocarbon emissions of greater than 75%, including at least about 80%, 85% 90% or greater, compared to an identical method wherein the fuel is a diesel fuel; or
d) carbon monoxide emissions of greater than about 70%, 75%, 80%, or greater, compared to an identical method wherein the fuel is a diesel fuel.

8. The high-efficiency diesel fuel of claim 1, wherein the fuel is blended diesel fuel stock comprising one or more components including a high-efficiency diesel fuel, a cetane enhancer, an LTFT fuel, high-cetane distillates, high-cetane straight-run distillate, high-cetane overhead products, paraffin, isoparrafins, ethyl hexyl nitrate (EHN), and combinations thereof.

9. A high-efficiency diesel fuel blending agent comprising:
a) increased short-chain paraffin molecules, and
b) long chain paraffins with one to five isomeric short chain methyl, ethyl, propyl, or isopropyl sidechains,
c) wherein the ratio of isoparaffins to total paraffins is greater than 0.99 isoparaffins to total paraffins.

10. The high-efficiency diesel fuel of claim 9, wherein the high-efficiency diesel fuel comprises short chain paraffins selected from the group consisting of C10, C11, C12, C13, C14, or C15 paraffins.

11. The high-efficiency diesel fuel of claim 9, wherein the high-efficiency diesel fuel comprises long chain paraffins selected from the group consisting of C15, C16, C17, C18, C19, C20, C21, C22, C23, C24, C25 or C26 isoparaffins, wherein the sidechains have 1-5 carbons in each of the sidechains, and less than 50 percent of the total carbons are in sidechains.

12. The high-efficiency diesel fuel of claim 9, wherein the high-efficiency diesel fuel comprises short chain paraffins ($C_{10}$-$C_{15}$) from diesel, kerosene, fuel oils, isomerized lube oil stocks, and other high paraffin fuel sources and long chain isoparaffins ($C_{15}$-$C_{26}$) from diesel, kerosene, fuel oils, isomerized lube oil stocks, and other high paraffin fuel sources.

13. The high-efficiency diesel fuel of claim 9, wherein the high-efficiency diesel fuel has a cetane number great than that of conventional diesel fuel, including a cetane number of about 51 to about 81, including a high efficiency diesel fuel with a derived cetane number of about 60, about 65, about 70, about 75, about 80, about 45 to 51, about 51 to 81, or above about 81, or greater than 85.

14. The high-efficiency diesel fuel of claim 9, wherein the fuel has a combustion efficiency between about 98% and 99%, reduced $NO_X$ emissions from about 0.5 g/kg$_{fuel}$ to 2.5 g/kg$_{fuel}$, reduced matter emissions of from about 0.4 g/kg$_{fuel}$ to 0.75 g/kg$_{fuel}$, reduced total hydrocarbon emissions of from about 2 g/kg$_{fuel}$ to 4 g/kg$_{fuel}$, reduced carbon monoxide emissions of from about 8.5 g/kg$_{fuel}$ to 15 g/kg$_{fuel}$, increases brake thermal efficiency between about 1.0% to 2.0%, compared to an identical method wherein the fuel is a conventional diesel fuel.

15. The high-efficiency diesel fuel of claim 9, wherein the fuel results in a decrease in one or more pollutants including:
a) nitrogen oxide ($NO_X$) emissions of greater than 10%, including at least about 17%, 18%, 19%, 20% or greater;
b) particulate matter emissions of greater than 55%, including about 63%, 65%, 68%, 70%, or greater;

c) total hydrocarbon emissions of greater than 75%, including at least about 80%, 85% 90% or greater; or d) carbon monoxide emissions of greater than about 70%, 75%, 80%, or greater, wherein said efficiency is compared to an identical method where the fuel is a diesel fuel.

16. The high-efficiency diesel fuel of claim 9, wherein the fuel is blended diesel fuel stock comprising one or more components including a high-efficiency diesel fuel, a cetane enhancer, an LTFT fuel, high-cetane distillates, high-cetane straight-run distillate, high-cetane overhead products, paraffin, isoparrafins, ethyl hexyl nitrate (EHN), and combinations thereof.

17. A method for reducing the emissions of a diesel engine, the method comprising a) combusting a fuel, wherein the fuel is a high-efficiency diesel fuel comprising increased short-chain paraffin molecules and long chain paraffins with one to five isomeric short chain methyl, ethyl, propyl, or isopropyl sidechains, wherein the ratio of isoparaffins to total paraffins is greater than 0.9, wherein the high-efficiency diesel fuel is injected at from −8 to 0 degrees After Top Dead Center (ATDC), and b) operating the engine with an exhaust gas recirculation (EGR) of from 20 to 60%.

18. The method for reducing the emissions of a diesel engine of claim 17, wherein the high-efficiency diesel fuel comprises short chain paraffins selected from the group consisting of C10, C11, C12, C13, C14, or C15 paraffins.

19. The method for reducing the emissions of a diesel engine of claim 17, wherein the high-efficiency diesel fuel comprises long chain paraffins selected from the group consisting of C15, C16, C17, C18, C19, C20, C21, C22, C23, C24, C25 or C26 isoparaffins, wherein the sidechains have 1-5 carbons in each of the sidechains, and less than 50 percent of the total carbons are in sidechains.

20. The method for reducing the emissions of a diesel engine of claim 17, wherein the high-efficiency diesel fuel comprises short chain paraffins ($C_{10}$-$C_{15}$) from diesel, kerosene, fuel oils, isomerized lube oil stocks, and other high paraffin fuel sources and long chain isoparaffins ($C_{15}$-$C_{26}$) from diesel, kerosene, fuel oils, isomerized lube oil stocks, and other high paraffin fuel sources.

21. The method for reducing the emissions of a diesel engine of claim 17, wherein the high-efficiency diesel fuel has a cetane number great than that of conventional diesel fuel, including a cetane number of about 51 to about 81, including a high efficiency diesel fuel with a derived cetane number of about 60, about 65, about 70, about 75, about 80, about 45 to 51, about 51 to 81, or above about 81, or greater than 85.

22. The method for reducing the emissions of a diesel engine of claim 17, wherein the fuel has a combustion efficiency between about 98% and 99%, reduced $NO_X$ emissions from about 0.5 $g/kg_{fuel}$ to 2.5 $g/kg_{fuel}$, reduced matter emissions of from about 0.4 $g/kg_{fuel}$ to 0.75 $g/kg_{fuel}$, reduced total hydrocarbon emissions of from about 2 $g/kg_{fuel}$ to 4 $g/kg_{fuel}$, reduced carbon monoxide emissions of from about 8.5 $g/kg_{fuel}$ to 15 $g/kg_{fuel}$, increases brake thermal efficiency between about 1.0% to 2.0%, compared to an identical method wherein the fuel is a conventional diesel fuel.

23. The method for reducing the emissions of a diesel engine of claim 17, wherein the fuel results in a decrease in one or more pollutants including:

a) nitrogen oxide ($NO_X$) emissions of greater than 10%, including at least about 17%, 18%, 19%, 20% or greater;

b) particulate matter emissions of greater than 55%, including about 63%, 65%, 68%, 70%, or greater;

c) total hydrocarbon emissions of greater than 75%, including at least about 80%, 85% 90% or greater; or d) carbon monoxide emissions of greater than about 70%, 75%, 80%, or greater, wherein said efficiency is compared to an identical method where the fuel is a diesel fuel.

24. The method for reducing the emissions of a diesel engine of claim 17, wherein the fuel is blended diesel fuel stock comprising one or more components including a high-efficiency diesel fuel, a cetane enhancer, an LTFT fuel, high-cetane distillates, high-cetane straight-run distillate, high-cetane overhead products, paraffin, isoparrafins, ethyl hexyl nitrate (EHN), and combinations thereof.

* * * * *